US008141810B2

(12) United States Patent
Smith

(10) Patent No.: US 8,141,810 B2
(45) Date of Patent: Mar. 27, 2012

(54) APPARATUS FOR WINDING A PAPER WEB

(76) Inventor: Philip W Smith, Beloit, WI (US)

( * ) Notice: Subject to any disclaimer, the term of this patent is extended or adjusted under 35 U.S.C. 154(b) by 0 days.

(21) Appl. No.: 12/317,494

(22) Filed: Dec. 22, 2008

(65) Prior Publication Data

US 2011/0108657 A1 May 12, 2011

Related U.S. Application Data

(60) Provisional application No. 61/008,428, filed on Dec. 20, 2007.

(51) Int. Cl.
*B65H 18/14* (2006.01)

(52) U.S. Cl. ..... 242/541.1; 242/541.4; 242/541.5; 242/541.6; 242/541.7

(58) Field of Classification Search ..... 242/541.1, 242/541.4–541.7
See application file for complete search history.

(56) References Cited

U.S. PATENT DOCUMENTS 5,611,500 A * 3/1997 Smith ..... 242/541.4
6,036,137 A * 3/2000 Myren ..... 242/541.7
6,047,917 A * 4/2000 Ekstrom et al. ..... 242/541.3
6,444,093 B1 * 9/2002 Luomi et al. ..... 162/202
6,550,713 B1 * 4/2003 Ruha et al. ..... 242/541.7
6,705,561 B2 * 3/2004 Mausser et al. ..... 242/541.1
6,913,223 B2 * 7/2005 Heinonen ..... 242/541.7
6,923,400 B2 * 8/2005 Mausser et al. ..... 242/541.1
6,964,394 B1 * 11/2005 Raty et al. ..... 242/541

* cited by examiner

*Primary Examiner* — Sang Kim
(74) *Attorney, Agent, or Firm* — David J. Archer

(57) ABSTRACT

An apparatus is disclosed for winding a paper web from a rotatable drum onto a driven spool which supports a reel. The apparatus includes a frame which includes a base having a first and a second end. A stand extends from the first end of the base for rotatably supporting the drum so that the paper web is guided by the drum. A further stand extends from the second end of the base. A carriage is slidably supported by the base such that sliding of the carriage between the first and second ends of the base is permitted. A moving device extends between the carriage and the further stand for moving the carriage relative to the drum. A reel in position control device is controllably connected to the moving device for selectively moving the carriage towards and away from the drum. The arrangement is such that when the reel supported by the driven spool is mounted on the carriage and the paper web is guided by the drum onto the reel, the paper web is controllably wound onto the core.

1 Claim, 2 Drawing Sheets

APPARATUS FOR WINDING A PAPER WEB

CROSS REFERENCE TO RELATED APPLICATION

The present application is a Complete application filed pursuant to Provisional application U.S. Ser. No. 61/008,428 filed Dec. 20, 2007. All the disclosure of the aforementioned Provisional application is incorporated herein by reference.

BACKGROUND OF THE INVENTION

1. Field of the Invention

The present invention relates to an apparatus for winding a paper web.

More specifically, the present invention relates to an apparatus for winding a paper web from a rotatable drum onto a driven spool which supports a reel.

2. Background of the Invention

In the prior art, when a web of paper is to be wound, such web is guided around a drum and the web is wound around a reel while a rider roll exerts pressure on the web as the web extends through a nip defined between the rider roll and the roll being wound. However, in the apparatus according to the present invention for winding a paper web or tissue, a spool which includes a cylindrical core or reel is lowered onto a rotating drum which accelerates the spool. The web is transferred to the spinning reel supported on the spool. As the core of the spool is wound, pressure is applied by means of a hydraulic control for urging the spool and core towards the drum. The pressure is continuously adjusted in order to wind the resultant roll to a predetermined size.

Therefore, the primary feature of the present invention is the provision of an apparatus for winding a paper web that overcomes the problems associated with the prior art devices and which makes a significant contribution to the papermaking art.

Another feature of the present invention is the provision of an apparatus for winding a paper web that simplifies the process of winding a web onto a reel.

Other features and advantages of the present invention will be readily apparent to those skilled in the art by a consideration of the detailed description of a preferred embodiment of the present invention contained herein.

SUMMARY OF THE INVENTION

The present invention relates to an apparatus for winding a paper web from a rotatable drum onto a driven spool which supports a reel. The apparatus includes a frame which includes a base having a first and a second end. A stand extends from the first end of the base for rotatably supporting the drum so that the paper web is guided by the drum. A further stand extends from the second end of the base. A carriage is slidably supported by the base such that sliding of the carriage between the first and second ends of the base is permitted. A moving device extends between the carriage and the further stand for moving the carriage relative to the drum. A reel in position control device is controllably connected to the moving device for selectively moving the carriage towards and away from the drum. The arrangement is such that when the reel supported by the driven spool is mounted on the carriage and the paper web is guided by the drum onto the reel, the paper web is controllably wound onto the core.

In a more specific embodiment of the present invention, the stand extends upwardly from the first end of the base.

Also, the stand includes a first portion and a second portion which is disposed spaced and parallel to the first portion so that the drum extends between the portions and is rotatably supported by the portions.

Furthermore, the further stand extends upwardly from the second end of the base.

Moreover, the carriage includes a first rail and a second rail which is disposed spaced and parallel to the rail such that the rails are bearingly supported by the base of the frame for permitting sliding of the carriage relative to the base.

Additionally, the carriage includes a first arm and a second arm which is disposed spaced and parallel relative to the first arm. The arrangement is such that the spool extends between the arms.

Also, an axis of rotation of the drum is disposed parallel and spaced relative to a rotational axis of the spool.

The axis of rotation of the drum is fixed while the rotational axis of the spool is movable so that a distance between the axes is controlled by the control device.

Further, the carriage includes a drive which is drivably connected to the spool for rotating the spool and the reel supported thereon.

Moreover, the moving device includes a hydraulic cylinder having a first and a second extremity. The first extremity of the hydraulic cylinder is connected to the carriage, the second extremity of the hydraulic cylinder being connected to the further stand. The hydraulic cylinder is connected to a source of pressurized hydraulic fluid.

The reel in position control device is connected to the hydraulic cylinder for controllably moving the carriage.

Additionally, the reel in position control device is controllably connected to the drive so that when the reel has been wound, the control device disconnects the drive from the spool.

Many modifications and variations of the present invention will be readily apparent to those skilled in the art by a consideration of the detailed description contained hereinafter taken in conjunction with the annexed drawings which show a preferred embodiment of the present invention. However, such modifications and variations fall within the spirit and scope of the present invention as defined by the appended claims.

BRIEF DESCRIPTION OF THE DRAWINGS

Similar reference characters refer to similar parts throughout the various views of the drawings.

DETAILED DESCRIPTION OF THE DRAWINGS

Figure 1:
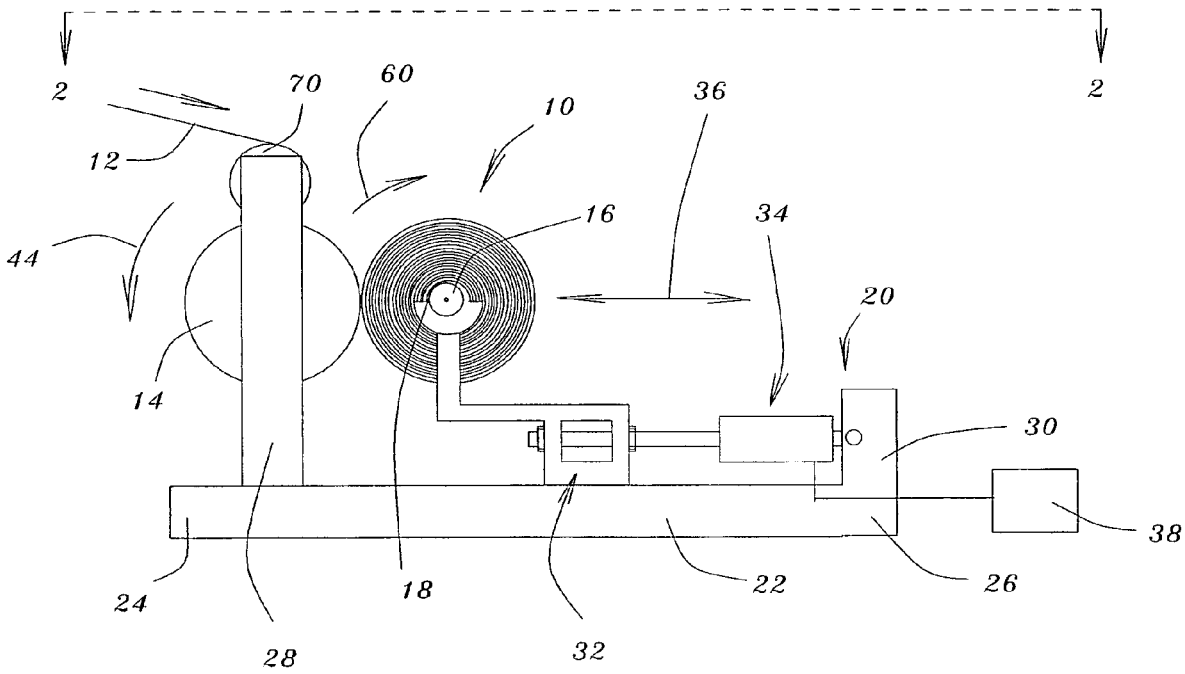
FIG. 1 is a side elevational view of an apparatus according to the present invention for winding a paper web from a rotatable drum onto a driven spool which supports a reel.

FIG. 1 is a side elevational view of an apparatus generally designated 10 according to the present invention for winding a paper web 12 from a rotatable drum 14 onto a driven spool 16 which supports a reel 18. As shown in FIG. 1, the apparatus 10 includes a frame generally designated 20 which includes a base 22 having a first end 24 and a second end 26. A stand 28 extends from the first end 24 of the base 22 for rotatably supporting the drum 14 so that the paper web 12 is guided by the drum 14. A further stand 30 extends from the second end 26 of the base 22. A carriage generally designated 32 is slidably supported by the base 22 such that sliding of the carriage 32 between the first and second ends 24 and 26 of the base 22 is permitted. A moving device generally designated 34 extends between the carriage 32 and the further stand 30 for moving the carriage 32 relative to the drum 14 as indicated by the arrow 36. A reel in position control device 38 is controllably connected to the moving device 34 for selectively moving the carriage 32 as indicated by the arrow 36 towards and away from the drum 14. The arrangement is such that when the reel 18 supported by the driven spool 16 is mounted on the carriage 32 and the paper web 12 is guided by the drum 14 onto the reel 18, the paper web 12 is controllably wound onto the core or reel 18.

In a more specific embodiment of the present invention, the stand 28 extends upwardly from the first end 24 of the base 22.

Figure 2:
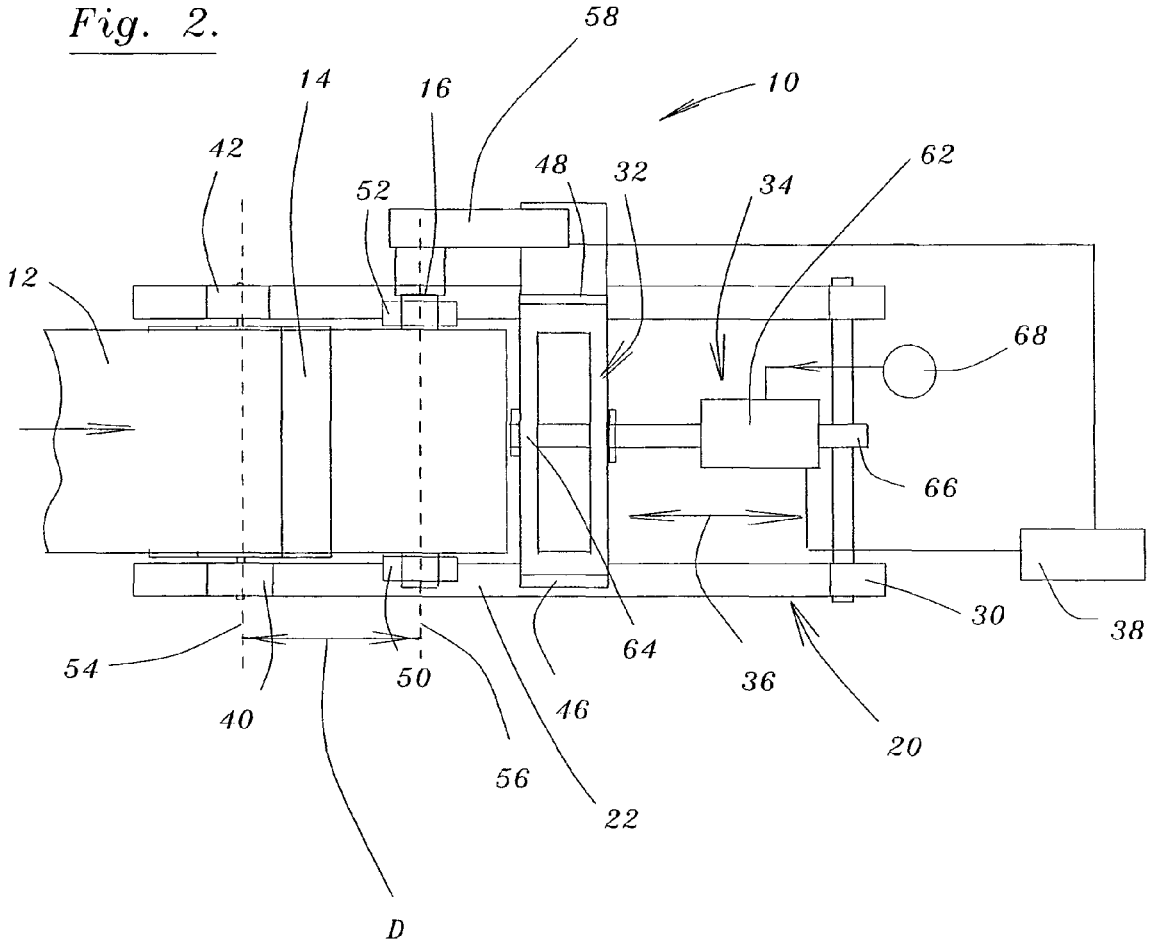
FIG. 2 is a view taken on the line 2-2 of FIG. 1.

FIG. 2 is a view taken on the line 2-2 of FIG. 1. As shown in FIG. 2, the stand 28 includes, a first portion 40 and a second portion 42 which is disposed spaced and parallel to the first portion 40 so that the drum 14 extends between the portions 40 and 42 and as shown in FIG. 1, is rotatably supported by the portions 40 and 42 as indicated by the arrow 44.

Furthermore, the further stand 30 extends upwardly from the second end 26 of the base. 22

Moreover, the carriage 32 includes a first rail 46 and a second rail 48 which disposed spaced and parallel to the first rail 46 such that the rails 46 and 48 are bearingly supported by the base 22 of the frame 20 for permitting sliding of the carriage 32 relative to the base 22 as indicated by the arrow 36.

Additionally, the carriage 32 includes a first arm 50 and a second arm 52 which is disposed spaced and parallel relative to the first arm 50. The arrangement is such that the spool 16 extends between the arms 50 and 52.

Also, an axis of rotation 54 of the drum 14 is disposed parallel and spaced relative to a rotational axis 56 of the spool 16.

The axis of rotation 54 of the drum 14 is fixed while the rotational axis 56 of the spool 16 is movable as indicated by the arrow 36 so that a distance D between the axes 54 and 56 is controlled by the control device 38.

Further, the carriage 32 includes a drive 58 which is drivably connected to the spool 16 for rotating the spool 16 and the reel 18 supported thereon as shown in FIG. 1 and as indicated by the arrow 60.

Moreover, the moving device 34 includes a hydraulic cylinder 62 having a first and a second extremity 64 and 66 respectively. The first extremity 64 of the hydraulic cylinder 62 is connected to the carriage 32, the second extremity 66 of the hydraulic cylinder 62 being connected to the further stand 30. The hydraulic cylinder 62 is connected to a source of pressurized hydraulic fluid 68.

The reel in position control device 38 is connected to the hydraulic cylinder 62 for controllably moving the carriage 32 as indicated by the arrow 36.

Additionally, the reel in position control device 38 is controllably connected to the drive 58 so that when the reel 18 has been wound, the control device 38 disconnects the drive 58 from the spool 16.

In operation of the apparatus according to the present invention, the paper web 12 is guided about a guide roll 70 as shown in FIG. 1 and around the drum 14 so that a leading edge of the paper web 12 is wrapped around the reel or core 18. that is rotated by the driven spool 16. As the new roll of paper is wound onto the reel 18, instead of having a rider roll form a nip for pressing the web 12 against the reel 18 or moving the drum 14 against the reel 18, in the present invention, the driven spool is controllably moved to adjust the tension of the paper web 12 and the pressure exerted between the drum 14 and the paper web 12 as it is being wound into a roll.

The present invention provides a unique apparatus for controllably winding a paper web to form a wound roll.

What is claimed is:

1. An apparatus for winding a paper web from a rotatable drum onto a driven spool which supports a reel, said apparatus comprising:

a frame;

said frame including:

a base having a first and a second end;

a stand extending from said first end of said base for rotatably supporting the drum so that the paper web is guided by the drum;

a further stand extending from said second end of said base;

a carriage slidably supported by said base such that sliding of said carriage between said first and second ends of said base is permitted;

a moving device extending between said carriage and said further stand for moving said carriage relative to the drum;

a reel in position control device controllably connected to said moving device for selectively moving said carriage towards and away from the drum such that when the reel supported by the driven spool is mounted on said carriage and the paper web is guided by the drum onto the reel, the paper web is controllably wound onto the core;

said stand extends upwardly from said first end of said base;

said stand includes:

a first portion;

a second portion disposed spaced and parallel to said first portion so that the drum extends between said portions and is rotatably supported by said portions;

said further stand extends upwardly from said second end of said base;

said carriage includes:

a first rail;

a second rail disposed spaced and parallel to said first rail such that said rails are bearingly supported by said base of said frame for permitting sliding of said carriage relative to said base;

said carriage includes:

a first arm;

a second arm disposed spaced and parallel relative to said first arm such that the spool extends between said arms;

an axis of rotation of the drum is disposed parallel and spaced relative to a rotational axis of the spool;

said axis of rotation of the drum is fixed while said rotational axis of the spool is movable so that a distance between said axes is controlled by said control device;

said carriage includes:

a drive drivably connected to the spool for rotating the spool and the reel supported thereon;

said moving device includes:

a hydraulic cylinder having a first and a second extremity, said first extremity of said hydraulic cylinder being connected to said carriage, said second extremity of said hydraulic cylinder being connected to said further stand, said hydraulic cylinder being connected to a source of pressurized hydraulic fluid;

said reel in position control device is connected to said hydraulic cylinder for controllably moving said carriage; and said reel in position control device is controllably connected to said drive so that when said reel has been wound, said control device disconnects said drive from said spool.

* * * * *